United States Patent [19]

Pomponio

[11] 4,414,439

[45] Nov. 8, 1983

[54] TIMED SWITCH

[75] Inventor: Edward V. Pomponio, Milford, Mass.

[73] Assignee: Timex Corporation, Waterbury, Conn.

[21] Appl. No.: 373,363

[22] Filed: Apr. 30, 1982

[51] Int. Cl.[3] ..... H01H 7/08

[52] U.S. Cl. ..... 200/38 R; 200/38 A; 200/38 FB; 368/250

[58] Field of Search ..... 200/35 R, 35 H, 35 B, 200/35 EQ, 35 A, 35 W, 36, 37 R, 37 A, 38 R, 38 A, 38 F, 38 FA, 38 FB, 38 B, 38 BA, 38 C, 38 CA, 38 D, 38 DA, 38 DB, 38 DC, 38 E, 39 R, 39 A; 368/250, 254, 109; 340/309.1; 307/141

[56] References Cited

U.S. PATENT DOCUMENTS 2,578,632 12/1951 Miller ..... 200/38 R 3,138,674 6/1964 Boyles ..... 200/38 FB 3,432,625 4/1967 Polonsky et al. ..... 200/35 R

*Primary Examiner*—Elliot A. Goldberg

*Assistant Examiner*—Morris Ginsburg

*Attorney, Agent, or Firm*—William C. Crutcher

[57] ABSTRACT

An electric switch is either automatically actuated by a motor driven timer or manually actuated, as determined by turning a three-position selector. The timed switch may be used with a conventional motor-driven clock and uses a commercially available microswitch which can provide either timed-"ON" or timed-"OFF" operation. Rotation of the selector in either direction causes longitudinal displacement of a spring-loaded actuator, which operates the switch. The selector has latching arms which are latched either in a manual position or in the automatic timed position.

6 Claims, 9 Drawing Figures

TIMED SWITCH

BACKGROUND OF THE INVENTION

This invention relates to improvements in timed switches, more particularly timed switches of the type having a three-position selector for either manual or for automatic timed actuation.

Timed switches are well known, of the type shown in U.S. Pat. No. 3,138,674, issued June 23, 1964 to R. L. Boyles, wherein a conventional clock mechanism comprising a motor, timing gear train, and indicating hands is provided with additional means to actuate an electric switch at a selectable time. The time is selected by a manually rotatable setting gear, which is coaxially disposed and axially movable with respect to a timing gear. At a particular position of the timing gear with respect to the setting gear, the two are displaced apart from one another by mutually coacting cams to unlatch a spring biased selector arm which closes a switch.

The arrangement shown in the Boyles patent utilizes a switch contact bar, which doubles both as a switch closure member and as a cam traveler. This offers no flexibility as to easy substitution of switches of different amperage ratings, or changing from timed "ON" to timed "OFF" operation.

The Boyles patent utilized a helical spring both as a torsional and as a compressional spring biasing means. This spring, and the design of the automatic latching arm resulted in considerable frictional resistance on the drive mechanism when automatically actuating the switch. Improvements in the latter problem are seen in the timed switch disclosed in U.S. Pat. No. 3,432,625, issued Mar. 11, 1969, to S. Polonsky et al. Polonsky shows a three positioned rotatable selector included a pair of latching arms, one of which interacts with a fixed detent, and the other of which includes a projection captured within a rotatable cup-shaped detent on the setting gear in the automatic position. Axial displacement of the setting gear will unlatch the automatic latching arm. In the Polonsky patent, spring biasing of the selector to the center position is accomplished by means of a resilient conductive wire contact member passing against a flat surface on the selector shaft. Again, the integration of the switch contact members into the mechanical aspects of the timer release mechanism made it difficult to utilize switches of different ratings or functions which were commercially available.

A timed switch mechanism would be desirable which enables the use of standard microswitches of higher rating, and which utilizes relatively few components which are easy to assemble.

Accordingly, one object of the present invention is to provide improvements in a timed three-position switch.

Another object of the invention is to provide an improved timed switch, which is simple to manufacture and assemble.

DRAWINGS

The invention, both as to organization and method of practice, together with further objects and advantages thereof, will best be understood by reference to the following description, taken in connection with the accompanying drawings, in which:

FIG. 1 is a front elevation drawing of a clock having a three-position timed switch in accordance with the invention, FIG. 2 is a side elevation drawing, partly in section of the clock drive, switch and selector/actuator mechanism, FIG. 3 and FIG. 4 are side view and end view, respectively, partly in section, of the selector, FIG. 5 and FIG. 6 are side view and end view, respectively, of the switch actuator, and FIGS. 7, 8 and 9 are schematic drawings (not to scale) illustrating the three operative positions of the timed switch.

SUMMARY OF THE INVENTION

Briefly stated, the invention is practiced by providing in a timed switch of the type having a motor driving a timing gear and a coaxially disposed setting gear with means to axially shift the gears with respect to one another, the improvement comprising a switch block carrying an electric switch with a depressible button, an actuator which is longitudinally movable in the switch block to depress the switch button, means biasing the actuator away from the switch button, and a rotatable selector with a manual latching arm and an automatic latching arm, the selector having a cam cooperating with the actuator to move the actuator longitudinally toward the switch upon rotation of the selector in either rotational direction, the switch block including a fixed detent for retaining the manual latching arm in one position and the setting gear including a cup detent for retaining the automatic latching arm in the opposite rotational position until unlatched by the timing mechanism.

DESCRIPTION OF THE PREFERRED EMBODIMENT

Figure 1:
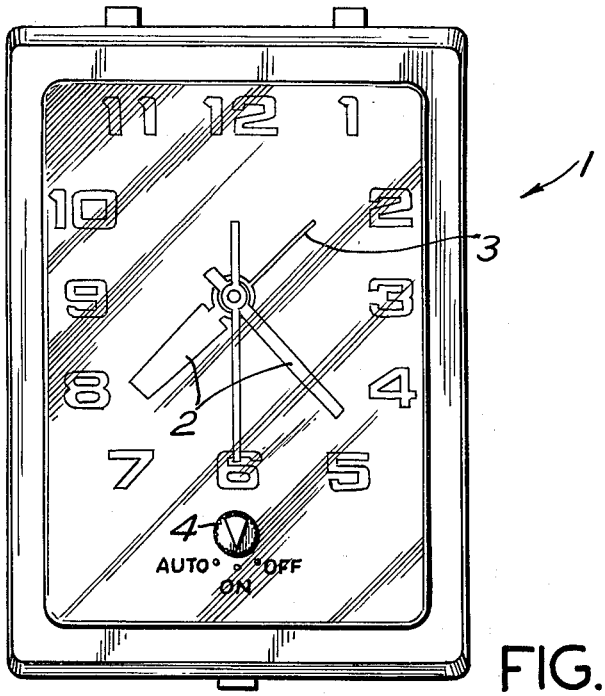

Referring to FIG. 1 of the drawing, a clock 1 has a conventional set of time indicating hands 2 and a timer setting indicator 3. The clock also includes a selector shaft 4 with an indicator for selecting one of three rotational positions "AUTO", "ON" and "OFF".

Figure 2:
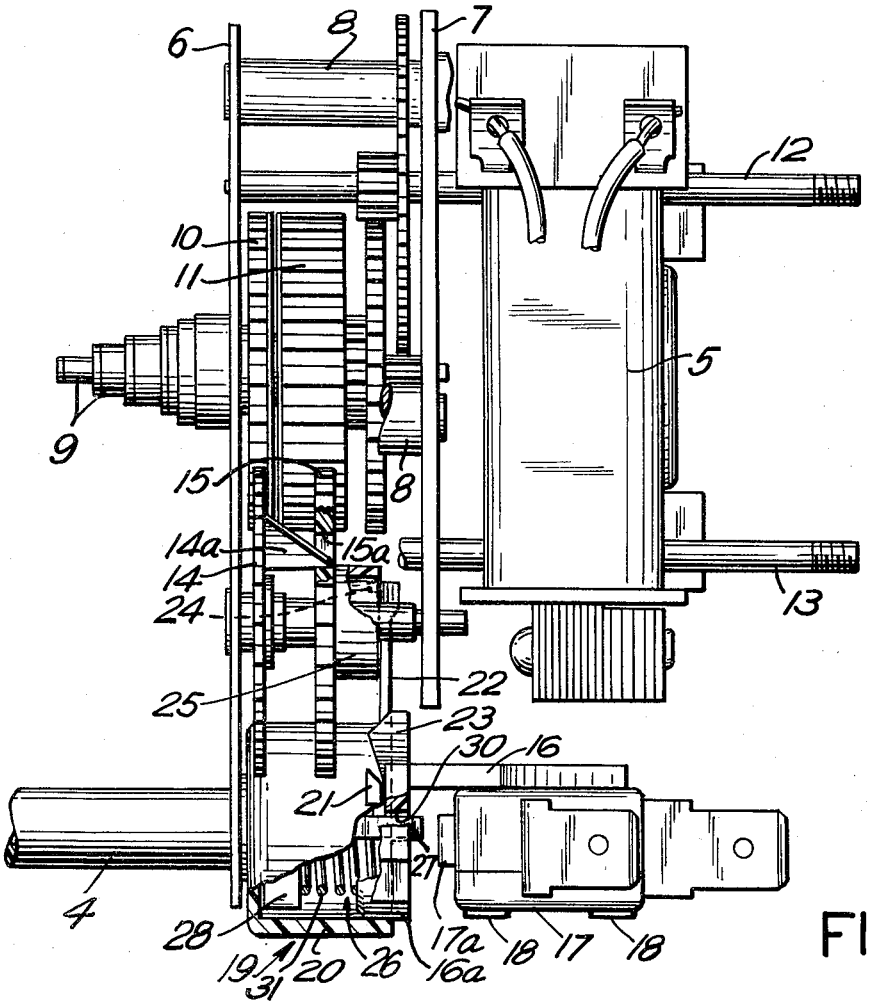

Referring to the side view of FIG. 2, portions of the clock motor and drive mechanism are shown, with nonessential elements omitted for purpose of clarity. The conventional members include an electric drive motor 5, front and back frame plates, 6, 7 maintained apart by pillar blocks 8. The motor drives a conventional gear train, reducing the speed of the motor to operate the shaft members 9, on which the hands are press fitted (FIG. 1). Portions of the gear train include a pair of separately adjustable coaxial gear members 10, 11. Gear member 11 is part of the timing gear train, while a gear 10 of smaller axial width is manually rotatable by means of a timing selector gear train actuated by a shaft 13 extending from the back of the unit. A similar timesetting shaft 12 is used for manually rotating gear 11 to set the time.

Gear 11 drives a timing gear 15, while gear 10 drives a setting gear 14. Gears 14, 15 are coaxially disposed on the same shaft member. Gear 15 also may be shifted in an axial direction with respect to gear 14 while still being driven by gear 11, due to the added width of gear 11. Means to bring about the axial shifting include a cam tab **14*a* struck out of the face of gear 14 and a slot 15*a* in the face of gear 15. Therefore at one particular angular position of gear 14 with respect to gear 15**, the gears may move axially towards one another, this serving to unlatch the automatic timer as will be described. The foregoing mechanism is conventional and fully described in the Polonsky et al. U.S. Pat. No. 3,432,625, which is incorporated herein by reference.

In accordance with the present invention, the timed switch further includes a switch block 16 supported from the front frame member 6. Attached to the switch block is a conventional microswitch 17, such attachment being provided with a depressible button 17*a*. Switch 17 is attached by upsetting the ends of plastic pillars 18, extending through holes (not shown) in the body of switch 17.

The selector, designated generally as 19, includes a cup 20 having a radially extending resilient manual latching arm 21 and a circumferentially spaced, radially extending resilient automatic latching arm 22. The selector is rotatably supported on one end by selector shaft 4 passing through a hole in the front frame plate 6. On the other end it is supported by a circular flange 16*a* projecting from the switch block 16 into the selector cup 19.

The manual latching arm 21 is arranged to cooperate with a fixed detent 23 on switch block 16 when the selector 19 is rotated in one direction. The automatic latching arm 22 has a projection 24 on its end, which is arranged to drop into the interior of a cup detent 25 on the setting gear 15 when the automatic latching arm 22 is rotated in the opposite direction, provided, also, that the setting gear 15 is shifted axially toward the arm 22. The resiliency of the latching arm provides the spring force to shift the gear 15 toward gear 14 as described in the aforementioned Polonsky et al. patent.

Disposed partially inside the selector cup 19 is an actuator, shown generally as 26. Actuator 26 includes a plunger 27 aligned with the depressible button, 17*a* on switch 17. Actuator 26 also includes cruciform cam following members 28. Cam surfaces 32 (see FIGS. 3 and 4) are arranged to force actuator 26 to the right in a longitudinal direction toward the switch button 17*a* when the selector shaft 4 is rotated either in one rotational direction or in the opposite rotational direction. A slot 30 in the switch block 16 receives the plunger 27 of the actuator to prevent it from rotating and thus serves as a guiding means, so that the actuator moves longitudinally when the selector 19 is rotated. A compression spring 31 in the cup provides spring force to bias the actuator 26 longitudinally away from the switch.

Figure 3:
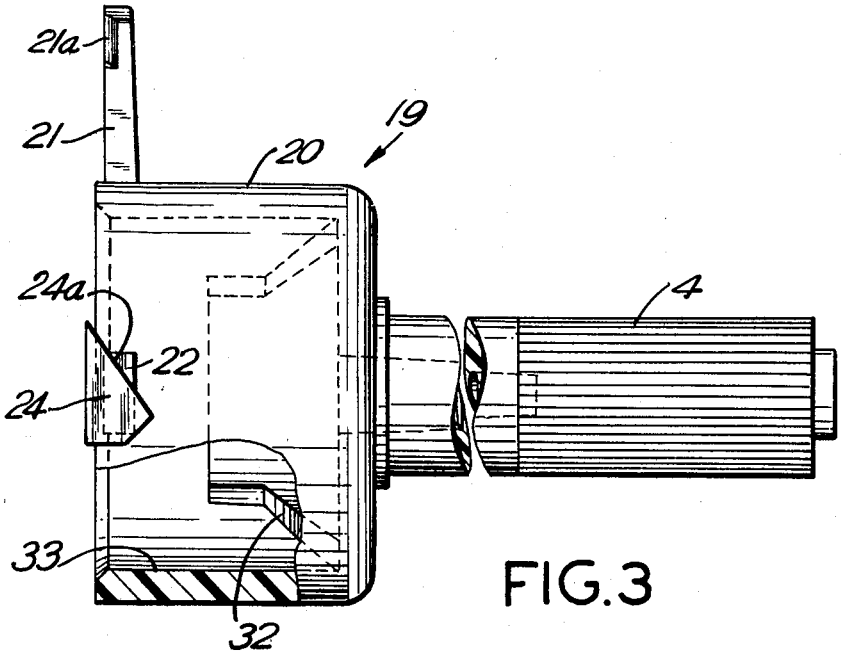
Figure 4:
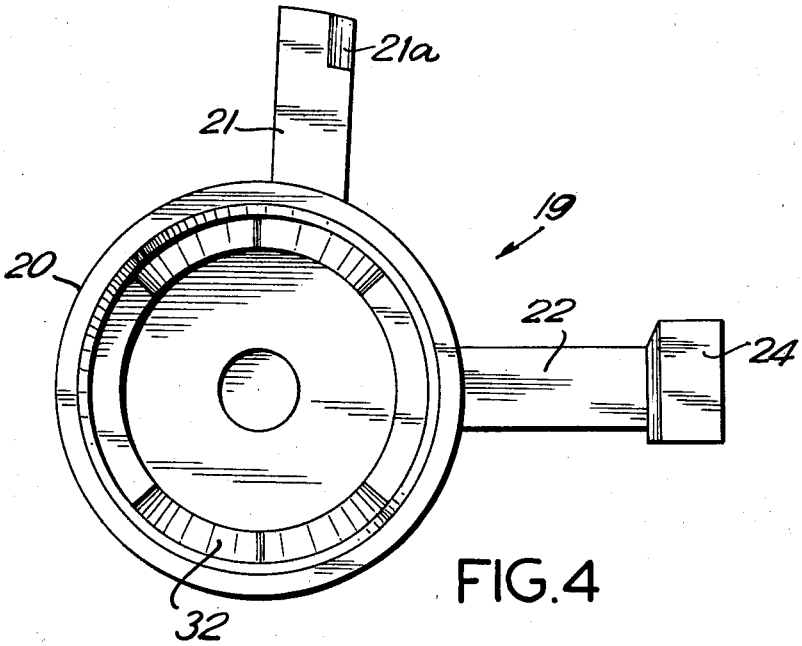

Referring to FIGS. 3 and 4, the details of the selector 19 can be seen more clearly. The automatic latching arm 22, and the latching projection 24 on the end thereof are angularly displaced approximately 90 degress from the manual latching arm 21. Projection 24 has an inclined surface 24*a* to enable it to ride over the edge of the detent cup 25. The resiliency of arm 22 holds projection 24 in place inside the cup and biases gear 15 toward gear 14. Similarly, the manual latching arm 21 includes a beveled surface 21*a* which enables it to ride over an inclined surface of the stationary or fixed detent 23.

Inside the walls of the cup 20 are cam surfaces 32 which are inclined both in a circumferential and axial direction so as to move the actuator up out of the selector cup from its lowest position inside the cup. The cup includes an inner circumferential wall surface 33 which rides on a corresponding flange 16*a* on the switch block (see FIG. 2) to support the other end of the actuator.

Figure 5:
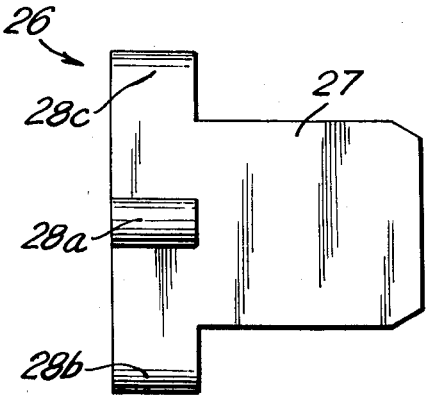
Figure 6:
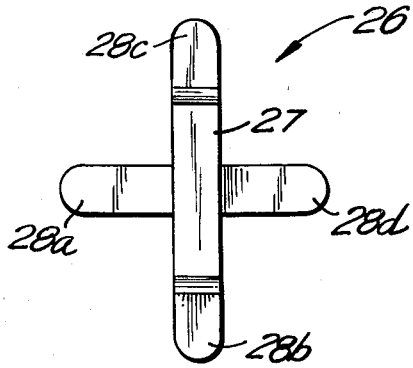

Referring now to FIGS. 5 and 6 of the drawing, actuator 26 includes a plunger 27 of rectangular cross section which is guided by a corresponding slot 20 in the switch block. The other end of actuator 26 includes two rounded cam followers 28*b* and 28*c*. Arms 28*a* and 28*d* of actuator 26 stabilize actuator 26 inside cup 20. These rest in the bottom of the cup 20 (FIG. 2) and are raised by cam surfaces 32 (FIGS. 3 and 4).

Figure 9:
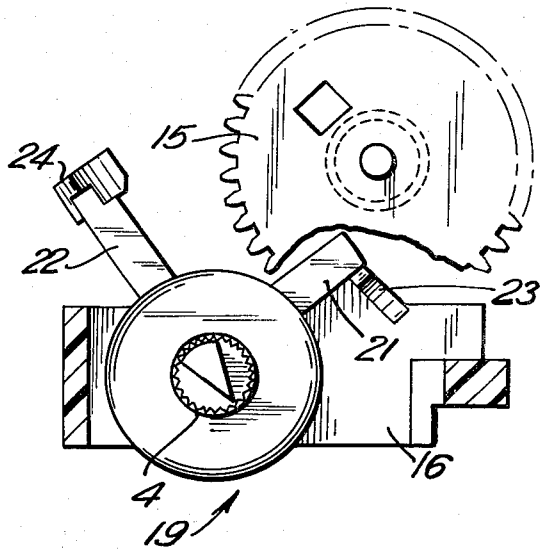
Figure 8:
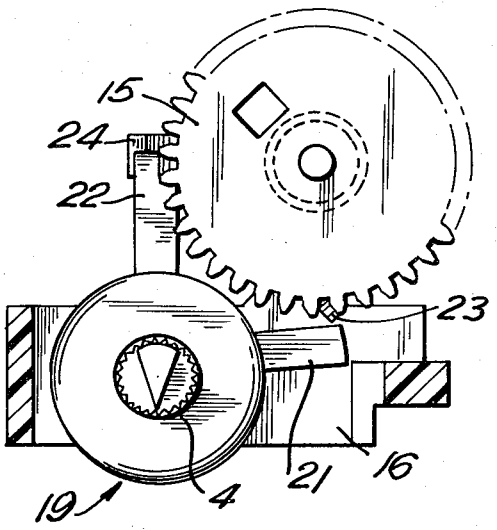
Figure 7:
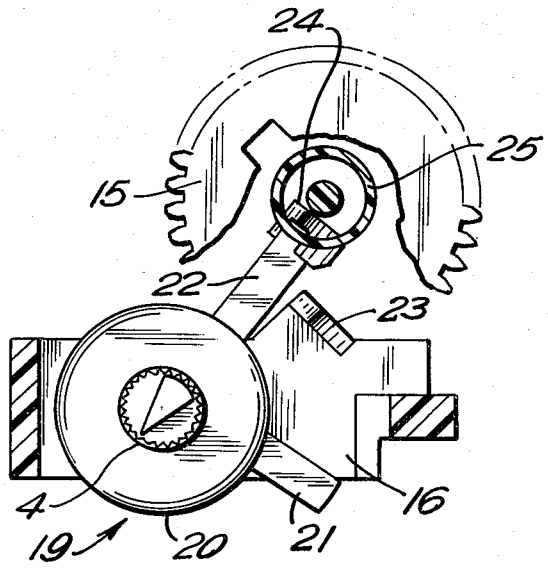

Reference to schematic FIGS. 7, 8 and 9 shows the three selector positions and the operation of the latching arms. Referring first to FIG. 8, the selector 19 is in the center or neutral position with neither latching arm operative.

In FIG. 9, the selector 19 has been rotated counter clockwise until the manual latching arm 21, which is resilient for this purpose, has passed over detent 23, which holds the selector in position. The selector may be turned back to the center position manually in the same manner.

In FIG. 7, the selector 19 has been rotated clockwise until the automatic latching arm 22 is aligned with the axis of gear 15. In this manner, the walls of cup detent 25 will retain the latching arm in position, provided that the gear 15 has been forced away from timing gear 14 in a manner previously described and known in the art.

OPERATION

Rotation of the selector 19 in either rotational direction as shown in FIGS. 7 or 9 causes the actuator 26 to move under the action of cam surfaces 32 in the selector cup. The actuator 26 is forced out of the cup against the action of spring 31 until it depresses and actuates depressible button 17*a* of the switch. In one rotational direction, designated "OFF", the manual latching arm 21 locks the selector in place and the switch is off. In the opposite rotational direction, designated "AUTO", the switch is also off, provided, also, that the two gears 14 and 15 are not in the exact position permitting axial movement. The projection 24 on arm 22 will be held within detent cup 25 on the setting gear until the moment of release. Thereupon, biasing spring 31 will force the actuator 26 toward the bottom of the selector cup. This longitudinal force provides rotational torque on the shaft which causes the selector 19 to return to the center position, designated "ON", as shown in FIG. 8.

The arrangement described is a "timed-on" application, i.e., the switch turns on after a designated time, and requires a "normally on" standard mircoswitch. By substituting a "normally off" microswitch, a "timed-off" timed switch is provided, giving three selector positions for "AUTO", "OFF" and "ON", which will turn off a device after a selected time. Commercially available microswitches of any desired amperage rating can be chosen and easily substituted for switch 17.

While there is shown what is considered to be the preferred embodiment of the invention, other modifications and applications will occur to those skilled in the art. It is therefore intended that the upended claims shall cover all such modifications that do not depart from the true spirit and scope of the invention.

I claim:

1. In a timed switch of the type having a motor, a timing gear driven by said motor, a manually rotatable setting gear coaxially disposed and axially movable with respect to said timing gear and having means for axially shifting said gears with respect to one another at a time selectable by rotating the setting gear, the improvement comprising:

a. a switch block disposed near said gears having guide means thereon, b. an electric switch held by said switch block and having a depressible button to open or close the switch, c. an actuator longitudinally movable in said guide means and having a plunger adapted to depress said switch button, d. means biasing the actuator away from the switch, e. a rotatable selector having a manual latching arm and an automatic latching arm, said selector having cam means cooperating with the actuator to move the actuator longitudinally toward the switch upon rotation of the selector either in a first rotational direction or in an opposite rotational direction, and f. detent means cooperating with the manual and automatic latching arms to latch the selector after it has turned in either of said rotational directions and to release the automatic latching arm when said gears are shifted axially with respect to one another.

2. The combination according to claim 1, wherein said detent means for the manual latching arm comprises a fixed detent on the switch block.

3. The combination according to claim 1, wherein the detent means for the automatic latching arm comprises a flanged cup on said setting gear.

4. The combination according to claim 1, wherein said selector comprises a rotatable cup having cam surfaces therein and wherein said actuator has a portion disposed in said rotatable cup, and adapted to move the actuator longitudinally out of the cup in either direction of cup rotation.

5. The combination according to claim 1, wherein said selector comprises a rotatable cup, said actuator has a portion disposed in the cup and wherein said biasing means comprises a spring in the cup between said actuator and said switch block.

6. The combination according to claim 1, wherein said switch block includes a circular flange, wherein said selector includes a rotatable cup and a shaft, one end being supported by the shaft and the other end by said flange projecting into said cup.

* * * * *